United States Patent [19]

Degremont

[11] Patent Number: 5,074,763

[45] Date of Patent: Dec. 24, 1991

[54] TELESCOPIC MOVING EQUIPMENT FOR DRIVING A RECIPROCATING PUMP

[75] Inventor: Jean-Claude Degremont, Vascoeuil, France

[73] Assignee: Dosapro Milton Roy, Pont-Saint-Pierre, France

[21] Appl. No.: 668,016

[22] Filed: Mar. 12, 1991

[30] Foreign Application Priority Data

Mar. 29, 1990 [FR] France ..... 9004020

[51] Int. Cl.[5] ..... F04B 43/02; F01B 19/00

[52] U.S. Cl. ..... 417/413; 92/13.2; 92/13.7

[58] Field of Search ..... 417/413, 395; 92/13, 92/13.2, 13.7, DIG. 4

[56] References Cited

U.S. PATENT DOCUMENTS

| | | | |
|---|---|---|---|
| 2,929,253 | 3/1960 | Baldelli | 92/13.7 |
| 4,021,164 | 5/1977 | Tell | 417/395 |
| 4,167,896 | 9/1979 | Clements | 92/13.2 |

FOREIGN PATENT DOCUMENTS

| | | | |
|---|---|---|---|
| 74438 | 4/1894 | Finland | 417/395 |
| 2568530 | 4/1986 | France . | |
| 987441 | 3/1965 | United Kingdom . | |

*Primary Examiner*—Richard A. Bertsch
*Assistant Examiner*—Peter Korytnyk
*Attorney, Agent, or Firm*—Griffin, Branigan & Butler

[57] ABSTRACT

Moving equipment for applying reciprocating drive to the diaphragm of a mechanically actuated diaphragm pump of adjustable stroke, the moving equipment comprising a slider slidably mounted in a fixed guide co-operating at one of its ends with an eccentric drive device whose eccentricity defines the maximum amplitude of the stroke of the slider in the guide, and coupled at its other end to the membrane. The slider is telescopic, having two pieces slidable relative to each other parallel to the guide, one of the pieces being a driving piece which is coupled to the eccentric and the other of the pieces being a driven piece which is coupled to the diaphragm, both pieces being held pressed against each other when the slider is in a retracted state by means of a coupling member developing a determined holding force, while the driven piece of the slider possesses an abutment member which co-operates with an abutment whose position along the guide is adjustable to interfere with the stroke of said drive piece to limit its amplitude to a fraction of the maximum amplitude generated by rotation of the eccentric and which opposes the holding force with a force that is at least equal thereto, thereby causing the slider to be extended.

15 Claims, 4 Drawing Sheets

TELESCOPIC MOVING EQUIPMENT FOR DRIVING A RECIPROCATING PUMP

BACKGROUND OF THE INVENTION

There are two categories of diaphragm pump: pumps in which the diaphragm is actuated hydraulically, and those in which the diaphragm is actuated mechanically. In hydraulically-actuated pumps, a reciprocating piston acts in a chamber containing a determined volume of "drive liquid", with one of the walls of the chamber being constituted by the diaphragm to be actuated. Pushing the piston into the chamber causes the diaphragm to be pushed back into it working chamber whose volume is thus decreased. This constitutes the pump delivery stroke. In its reverse stroke, the piston establishes suction in the control liquid which pulls back the diaphragm. The volume of the working chamber increases. This is the pump suction stroke. The strength of the suction in this type of pump is limited by cavitation in the working liquid.

In a pump whose diaphragm is actuated mechanically, the diaphragm is coupled to reciprocating moving equipment. Several drive mechanisms exist for the moving equipment, which mechanisms are of the crank and connecting rod type or rather of the type comprising a slider coupled to an eccentric. In some of them, the eccentric acts like a cam which drives the moving equipment (during the pump delivery stroke), with return being provided resiliently. In others, the moving equipment is coupled to the eccentric via a coupling nut providing go and return drive.

The flow rate of such diaphragm pumps is adjusted by acting on two operating parameters: rate; and stroke amplitude. In practice, the rate is acted on by adjusting the speed of the motor driving the eccentric. The amplitude of the stroke is adjusted by mechanisms that depend on pump technology. Thus, for hydraulically-controlled pumps, for constant amplitude of the piston stroke, it is possible to adjust the quantity of control liquid that is displaced. To do this, the control chamber is contained in part in a cavity in the piston, which cavity includes lateral orifices in communication with a tank, said orifices being open over an adjustable fraction of the stroke around the bottom dead center position of the piston (at the end of the suction stroke). An example of this technique is illustrated in Document EP 148 691.

Otherwise, for mechanically-actuated pumps, the stroke is generally adjusted by limiting the return amplitude of the slider under drive from the return spring by means of an adjustable abutment, as described, for example, in Documents: U.S. Pat. No. 4,167,896 or GB-A-2 044 895.

There is no advantageous solution for adjusting the amplitude of the stroke when suction is achieved by the moving equipment being positively driven by the eccentric.

In some markets, such as treating waste water in particular, hydraulically-actuated pumps are still seen as being complicated devices requiring expensive monitoring and maintenance. In addition, users always fear that a rupture of the diaphragm will lead to the treated liquid mixed with the control fluid (oil) with severe pollution consequences. There exists a remedy for this risk which consists in installing two diaphragms together with a rupture detection device, but in the eyes of users used to simpler equipment, this merely complicates the apparatus.

The present invention is a response adapted to the state of the market, i.e. a mechanism for adjusting the flow rate of a mechanically-actuated pump presenting the same advantages as a hydraulically-controlled pump with respect to ease of adjustment and retaining pumping characteristics regardless of flow rate.

SUMMARY OF THE INVENTION

To this end, the present invention provides moving equipment for driving a reciprocating pump of adjustable stroke, the moving equipment comprising a slider slidably mounted in a fixed guide co-operating at one of its ends with an eccentric drive device whose eccentricity defines the maximum amplitude of the stroke of the slider in the guide, and coupled at its other end to the active pumping member which may either be a diaphragm or else, by extension, a rigid piston. Reference is made below to diaphragm pumps only, however the invention is applicable to any reciprocating pump whatever the nature of the piston coupled to the moving equipment.

According to the invention, the slider is telescopic having two pieces slidable relative to each other parallel to the guide, one of the pieces being a driving piece which is coupled to the eccentric and the other of the pieces being a driven piece which is coupled to the diaphragm, both pieces being held pressed against each other when the slider is in a retracted state by means of a coupling member developing a determined holding force, while the driven piece of the slider possesses an abutment member which co-operates with an abutment whose position along the guide is adjustable to interfere with the stroke of said driven piece to limit its amplitude to a fraction of the maximum amplitude generated by rotation of the eccentric and which opposes the holding force with a force that is at least equal thereto, thereby causing the slider to be extended.

In a first embodiment, the coupling member includes at least one moving item for locking together the two pieces and co-operating with a camming surface carried by one of the two pieces and tending to retract the moving item radially into a recess provided in the other piece against the force of a resilient return member which defines the predetermined force to be overcome to make it possible to extend the slider. This embodiment has two advantages: the first lies in the fact that the predetermined force to be overcome defines the suction strength of the pump which remains constant regardless of the stroke adjustment. The second results from the locking member retracting and then exterting no significant residual force between the driving piece and the driven piece of the slider, so that the stop abutment of the driven piece is no longer subjected to stress.

Preferably, the end of the driving piece of the slider furthest from the eccentric includes a bore in which the end of the driven piece furthest from the diaphragm is slidably received, the moving locking item being constituted by a ball received in a recess provided radially in one of the pieces and subjected to the effect of a resilient member tending to urge it out from the recess, the camming surface being constituted by the side of a groove provided in the other piece. If the recess is provided in the driven piece and the groove is provided in the driving piece, then in a first variant the resilient member is disposed in the radial recess, while in a second variant the resilient member is constituted by a spring received axially in the driven piece and interposed between a fixed abutment thereof and a cam which slides axially in the driven piece and which is urged by the spring to bear against the ball via a diverging cam surface. In which case, the cam or the driven piece includes a member for adjusting the spring setting.

If the recess is provided in the driving piece and the groove is in the driven piece, then the resilient member may be a resilient blade disposed in an outside groove of the driving piece into which the recess opens out.

In another form of this first embodiment, the coupling member includes a claw fixed to one of the pieces and having a plurality of teeth which are resiliently deformable in a radial direction and which have free ends, thereby forming the moving locking item, which teeth are engaged in a groove of the other piece when the slider is in the retracted state.

In a second embodiment, the coupling member comprises a locking crank pivoting on the driven piece and engaged behind an abutment of the driving piece when the slider is retracted under urging from a resilient member, the crank including an operating lever whose free end constitutes the abutment member of the driven piece pivoting against the effect of the resilient member in the crank disengagement direction when coming into contact with the abutment whose position along the guide is adjustable.

Finally, in a third embodiment, the coupling member is constituted by a rated resilient member disposed between the two pieces of the slider and whose effect tends to hold the slider in its retracted position under a determined force.

In each of the embodiments, except possibly the embodiment having an external resilient blade as mentioned above, the resilient member may be constituted by a peice of elastomer.

BRIEF DESCRIPTION OF THE DRAWINGS

Embodiments of the invention are described by way of example with reference to the accompanying drawings, in which.

DETAILED DESCRIPTION

Figure 1:
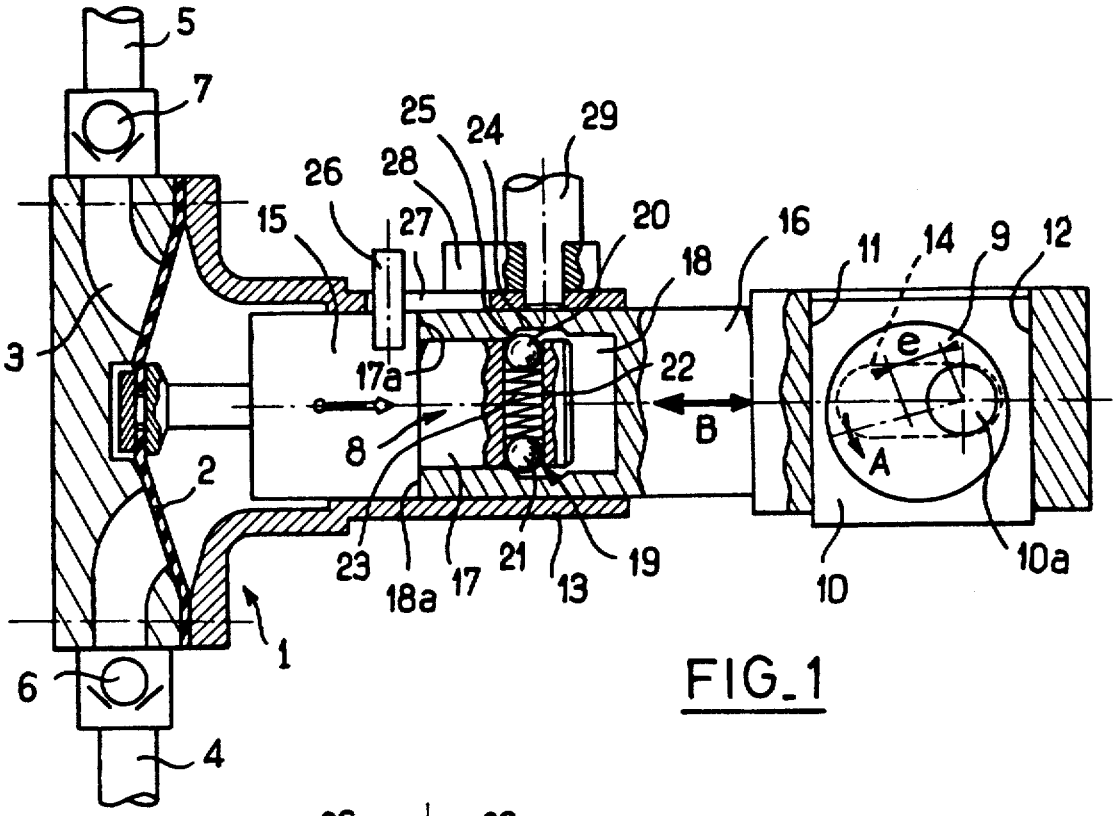
FIGS. 1, 2, and 3 are three diagrams illustrating the general means of the invention seen in section on the axial plane of symmetry of a membrane pump and shown in three particular states of the stroke of the moving equipment.

A diaphragm pump is shown diagrammatically in FIG. 1 and comprises a pumping head 1 in which a diaphragm 2 defines a pumping chamber 3 which is connected to a suction duct 4 and to a delivery duct 5 via respective non-return valves 6 and 7.

The diaphragm 2 of this pump is coupled to one of the ends of a slider 8 whose opposite end co-operates with a driving eccentric 9 via a sliding skid 10 which acts alternately on face 11 of the slider and on face 12 thereof to transform the continuous rotary motion A of the eccentric 9 into reciprocating rectilinear motion B of the slider.

The front portion of the slider 8 is guided by a fixed guide 13 belonging to the frame of the pump and its rear portion is supported by the rotary shaft 10*a* of the eccentric via the edges of a slot 14 through which the shaft passes. The section of the slider in the guide is circular, or of any other shape suitable for simple machining of the guide and of the slider.

The slider 8 is made of two pieces 15 and 16 so as to be telescopic. Thus, the piece 15 which is coupled to the diaphragm 2 has one end 17 mounted to slide parallel to the guide 13 in a bore 18 of the piece 16 which co-operates with the eccentric 9. In the retracted position of the slider, the front surface 18*a* of the piece 15 rests against a shoulder 17*a* of the piece 15, with the end 17 then being completely received in the bore 18.

The two pieces 15 and 16 are coupled together by a coupling device whose function is explained with reference to its diagrammatic representation 19 in FIGS. 1 to 3.

This device comprises two balls 20 and 21 received in a diametrically-extending recess 22 through the portion 17 of the piece 15. These two balls are engaged by a resilient member 23 tending to thrust them out from the recess. The bore 18 has a groove 24 disposed in such a manner that when the slider is retracted, the balls 20 and 22 penetrate under the effect of the resilient member 23 at least in part into the groove 24, bearing against the side 25 of the groove which faces away from the front surface 18*a* of the piece 16. The side 25 acts as a camming surface (and to this end it may be inclined) which receives the force developed by the resilient member 23 as transmitted by the balls, and which transmits an axial component therefrom to the piece 16 tending to keep said piece bearing against the shoulder 17*a* of the piece 15.

The magnitude of this force depends on the force generated by the resilient member 23 and on the geometry of the contacting surfaces of the balls 20, 21 and of the side 25 of the groove 24. It will thus be understood that so long as the force tending to separate the two pieces 15 and 16 is less than this coupling force, then the slider behaves as though it were made of a single piece. In contrast, if the force becomes greater than the coupling force, then the balls 20 and 21 are expelled from the groove 24 by the camming side 25 and the two pieces 15 and 16 slide relative to each other. It may be observed that the only force opposing such sliding is practically independent of the force developed by the spring 23 since it is equivalent merely to the friction forces between the balls and the walls of the bore 18.

The "driven" piece 15 possesses an abutment member which is represented in this case by a radial finger 26 passing through a slot 27 in the fixed guide 13, with the axial length of the slot being not less than the maximum amplitude of the stroke of the slider 8, i.e. $2e$ where e is the eccentricity of the cam 9 relative to its rotary shaft 10*a*. Facing the finger 26, the fixed guide carries an abutment 28 which is adjustable in position relative to the slot, depending on the sliding direction. In this case, the abutment 28 is made in the form of a disk which is eccentric relative to a pivot axis 29 and whose angular position about said axis can be set by conventional means (not described) which may include a manual adjustment knob. Thus, depending on the setting, the abutment 28 covers the slot 27 to a greater or lesser extent and limits the amplitude of movement on the finger 26 in said slot to a greater or lesser extent.

This adjustable abutment constitutes the member for adjusting the pump flow rate, other things being equal.

Assume initially that the abutment 28 is in a position revealing a sufficient length of the slot 27 to enable the finger 26 to travel over a distance 2*e*. Rotation of the eccentric cam 9 generates reciprocating motion in the slider 8. Its forward stroke (to the left in FIG. 1) constitutes the pump delivery stroke. Its rearwards stroke (to the right in FIG. 1) constitutes the pump suction stroke. During delivery, the driving force developed by the eccentric is transmitted to the diaphragm by the slider 8, with the two pieces 16 and 15 bearing against each other via their surfaces 18*a* and 17*a*. During suction, the driving force is transmitted to the diaphragm via the coupling mechanism 19, i.e. via the piece 15 being locked to the piece 16 by means of the balls.

The suction force corresponds to the suction column which it is desired to raise using the pump, and this is easily withstood by the coupling device 19 (an appropriate selection of spring 23 and of its setting for balls of determined sizes). When the pump is adjusted to its maximum flow rate capacity, the moving equipment thus behaves like a rigid connecting rod.

In order to obtain a fraction of the maximum flow rate, action is taken on the abutment 28 to cause it to interfere with the stroke of the finger 26 by overlying the slot 27. When the finger comes into contact with the disk 28, the piece 15 is prevented from continuing its stroke and the opposing force to which it is subjected overcomes the locking force. The balls 20 and 21 are then retracted into the recess 22, and the piece 16, now disconnected from the piece 15, is the only piece to continue to be driven by the eccentric. This state is shown in FIG. 2. The quantity of substances sucked into the chamber 3 is thus limited to a fraction of the total quantity that this chamber can admit by virtue of the reawards stroke of the membrane 2 being stopped prematurely.

Figure 3:
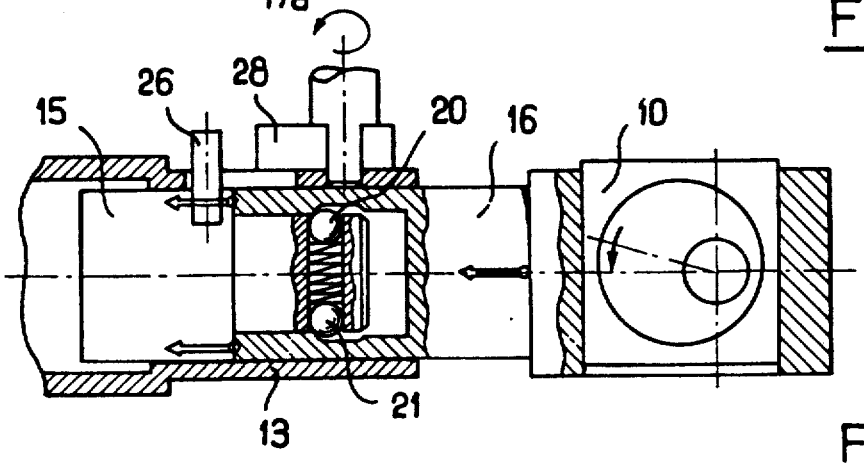

FIG. 3 shows the piece 16 returning towards the piece 15 with which it docks by means of the surface on front end 18*a* engaging the surface 17*a* of the shoulder since it is pushing towards pump top dead center to deliver the previously sucked in quantity of substance. Simultaneously, the groove 24 enables the balls 20 and 21 to return to their initial positions and the two pieces 15 and 16 are coupled together again.

The suction-delivery cycle is repeated in this manner for each revolution of the eccentric. It may be observed that as soon as the two pieces are uncoupled, the retaining force applied to the piece 15 by the abutment 28 is practically zero. Similarly, the torque opposing rotation of the eccentric while the pieces 15 and 16 are uncoupled is likewise practically zero. As a result, the energy expended and the extent to which the moving pieces are worn are both reduced. Further, since the coupling force is constant, the suction power of the pump which depends directly thereon remains constant regardless of the selected flow rate adjustment. The overall efficiency of the pump is thus improved and remains good regardless of the selected flow rate conditions.

Figure 2:
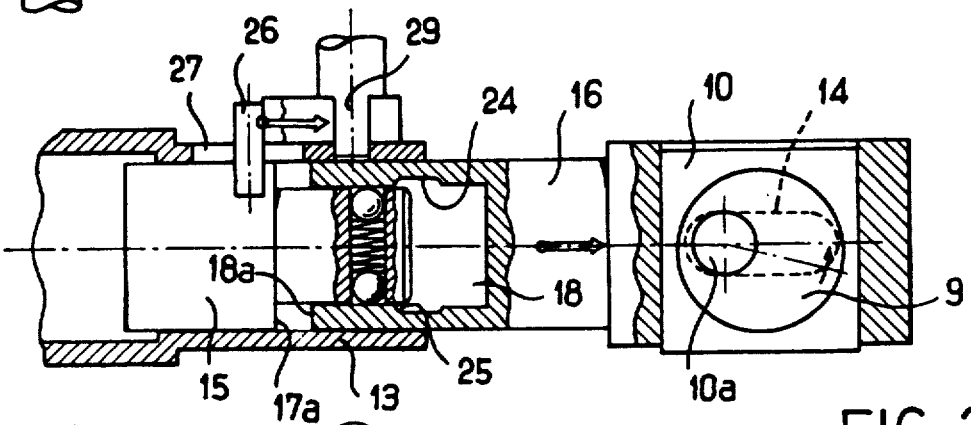
Figure 4A:
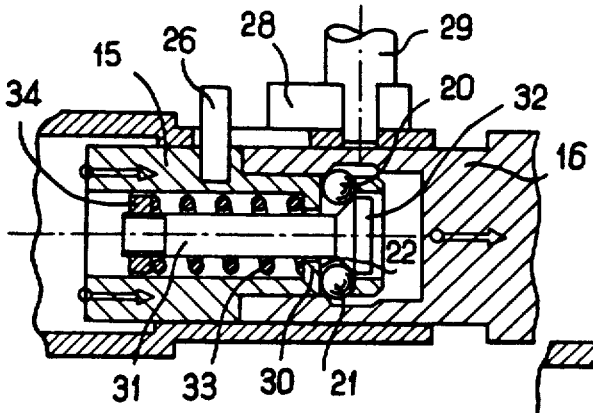
FIGS. 4A and 4B are sections showing a first embodiment of the invention with the moving equipment in two different states.
Figure 4B:
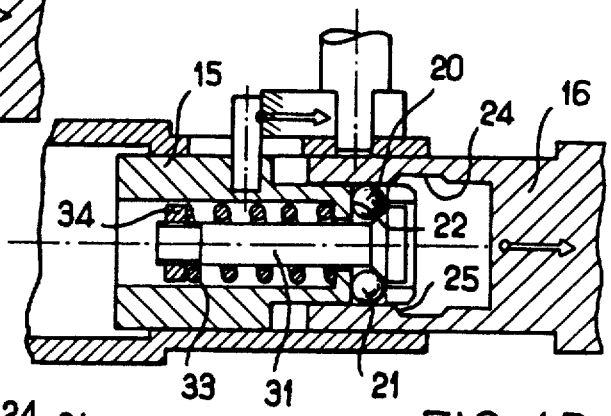

FIGS. 4A and 4B are section views through a first practical embodiment of the invention shown in the same states as the moving equipment in FIGS. 1 and 2 respectively. Some of the items already described reappear in these figures with the same references. The piece 15 is tubular in this case having an internal shoulder 30 for receiving a rod 31 having a valve-like head 32 that forms a camming surface which cooperates with the balls 20 and 21. A spring 33 is interposed between the shoulder 30 and a nut 34 fixed to the rod 31. The spring tends to press a portion of head 32 against the balls 20 and 21 to cause them to move radially out from their recess 22. The nut 34 serves to adjust the setting of the spring 33, and thus the coupling force between the pieces 15 and 16, and consequently the suction power of the pump. In this respect it may be observed that the disconnectable coupling constitutes a protective safety arrangement for the pump mechanism. If the suction duct 4 becomes blocked, then the opposing force may increase until it overcomes the coupling force which will then give way. This prevents subjecting the diaphragm to excessive stress which could cause it to rupture prematurely. Some shaped diaphragms withstand delivery force which is higher than the maximum to suction force they withstand.

Figure 4C:
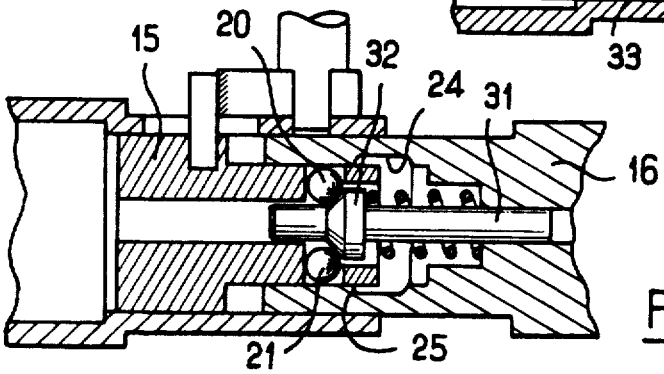
FIG. 4C shows a variant of a detail of this first embodiment.

FIG. 4C shows the items described in FIGS. 4A and 4B with the same references. The spring 33 is interposed in this case between the piece 16 and the end 32 of the rod 31 which slides in the piece 16. The advantage of this opposite disposition lies in the decrease in the force transmitted by the spring to the balls when the balls are retracted into their recess, since once the coupling has disconnected, the spring expands during the continued stroke of the piece 16.

Figure 5A:
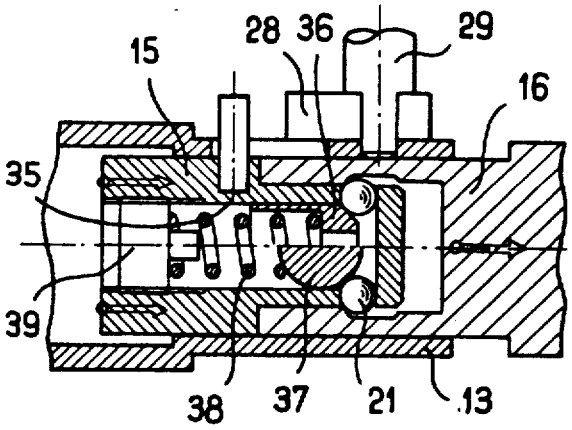
FIGS. 5A and 5B are two similar views showing a variant of the embodiment shown in FIGS. 4A and 4B.
Figure 5B:
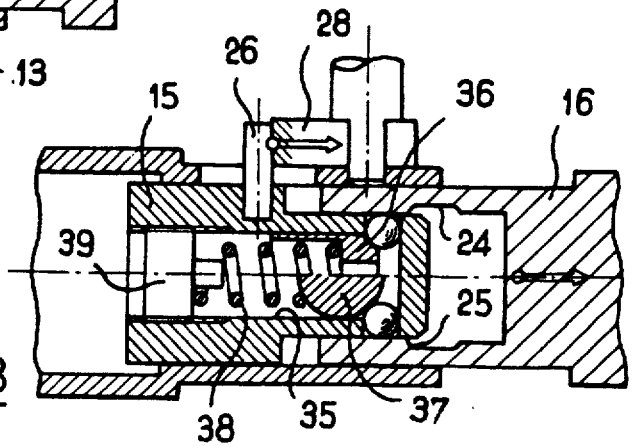
Figure 10:
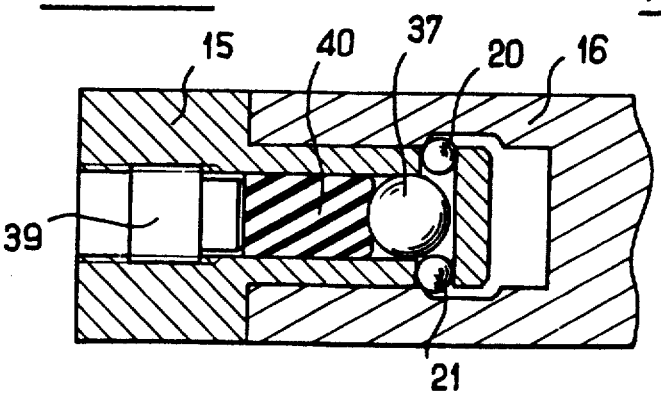
FIG. 10 is a diagram showing a variant of a detail.

Each of FIGS. 5A and 5B shows two variants of the preceding figures in the same states of the moving equipment. Here again, the piece 15 is tubular, with its bore being blind adjacent to the balls 20 and 21. It is mentioned that the balls may be greater than two in number, and that there are preferably three such balls, received in radial holes in the piece 15 at 120° intervals from one another. The bore 35 of the piece 15 receives a sliding pusher which may either be in the form of a punch 36 or else in the form of a ball 37 (with each of these items being shown in respective halves of the figures). A spring 38 is compressed behind the punch 36 or the ball 37 to cause the punch or the ball to bear against the balls 20 and 21 so as to force them towards the outside of the piece 15. A threaded plug 39 in the bore 35 serves to adjust the setting of the spring 38. Another embodiment of this variant is shown in FIG. 10 where the spring 38 is constituted by a block of elastomer 40 which is compressed behind the bore 37 by a threaded plug 39.

Figure 6A:
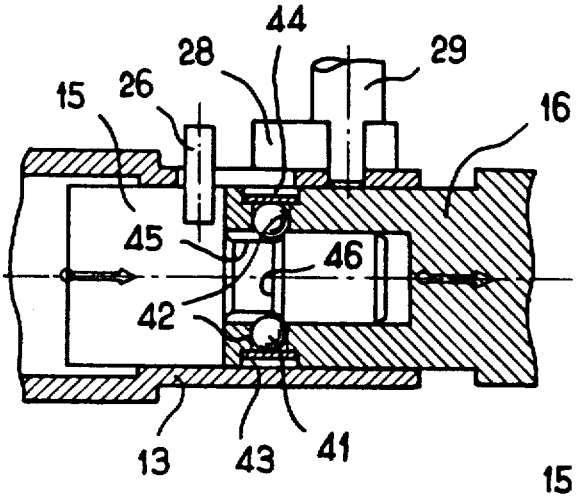
FIGS 6A and 6B show another variant embodiment of the moving equipment of the invention.
Figure 6B:
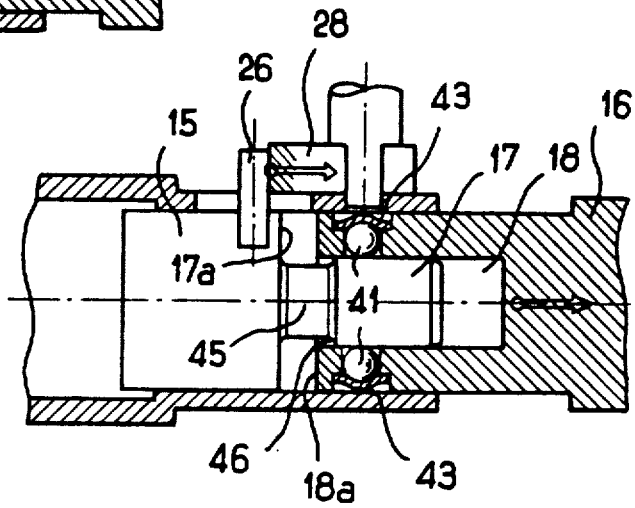

Apart from certain items already described with the same references, FIGS. 6A and 6B show a disposition which is opposite to the above dispositions with respect to the locations of the balls. The balls 41 are placed in recesses 42 in the piece 16 and they are urged to project into the inside of the bore 18 by external resilient blades 43 received in an external groove 44 of the piece 16 in such a manner as to be capable of deforming without fouling the guide 13. The portion of end 17 of the piece 15 has a groove 45 for receiving the balls 41 in part and for bearing against them via its side 46 facing towards the shoulder 17*a*. The resiliently deformable blade(s) 43 generate(s) a coupling force between the two pieces 15 and 16 for the same reasons as given above. FIG. 6B shows the resilient deformation of the blades when the balls 41 are forced into their recesses 42 after the connection between the pieces 15 and 16 has been released.

Figure 7A:
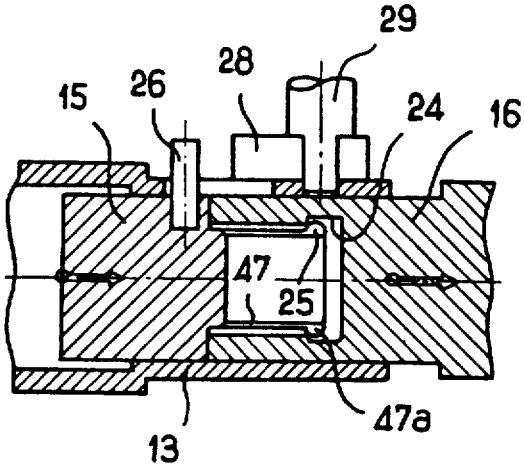
FIGS 7A and 7B are views similar to the preceding views showing another variant embodiment.
Figure 7B:
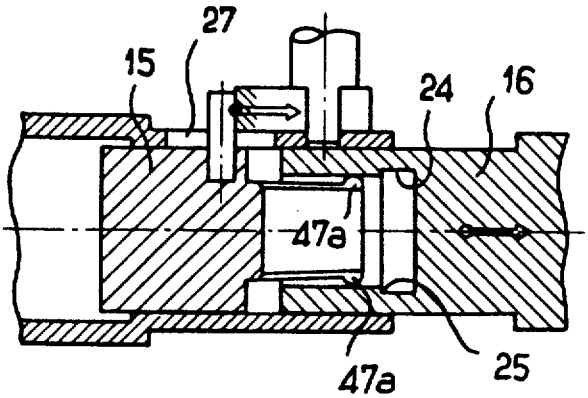

The coupling device shown in FIGS. 7A and 7B is a kind of resilient clamp possessing a plurality of resiliently deformable teeth 47 (made by splitting a cylindrical sleeve for example) integral with the piece 15. The ends 47*a* of these teeth are engaged in the groove 24 of the piece 16, which groove has one of its sides 25 constituting a camming surface for deflecting the ends 47*a* of these teeth when the connection is uncoupled. The teeth may be replaced by a cylindrical sleeve having an external flange capable of being resiliently deformed.

Figure 8A:
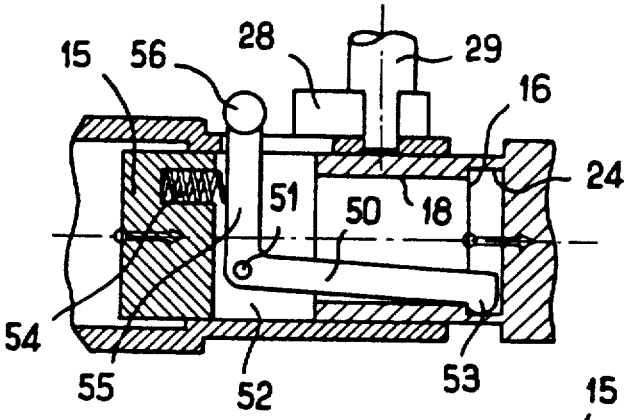
FIGS. 8A and 8B show a second embodiment of the moving equipment of the invention.
Figure 8B:
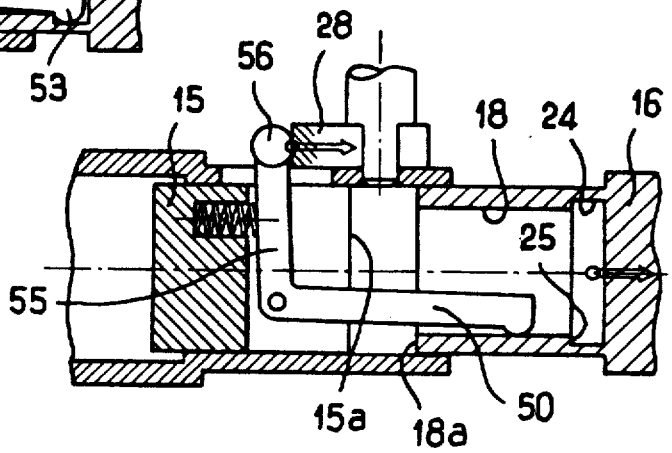

Another embodiment of the invention is shown in FIGS. 8A and 8B. The disconnectable connection between the two pieces is provided in this case by a crank 50 rocking about an axis 51 carried by the piece 15. Unlike the preceding embodiments, the piece 15 no longer has a portion that slides inside the bore 18 of the piece 16. The front surface 18*a* of the piece 16 bears against the trued end 15*a* of the piece 15 and the crank 50 rocks in a slot 52 in the piece 15. When the faces 18*a* and 15*a* are in contact, the end 53 of the crank can engage in the groove 24 behind its side 25 leading to the bore 18. This engagement is forced by a resilient member 54 which exerts its force on one of the levers 55 of the crank and which rocks therewith about the axis 51. The end 56 of said lever passes through the guide 13 via the slot 27 to co-operate with the abutment, with the lever 55 rocking about the axis 51 and raising the end 53 out from the groove 24 to release the connection between the pieces 15 and 16.

When the connection is released, the force of the resilient member 54, e.g. a spring on the crank as a whole is opposed by the end 53 bearing against the surface of the bore 18 and the end 56 bearing against the abutment 28. Finally, it may be observed that the connection between the pieces is re-established firstly when the trued end 15*a* and the front surface 18*a* are in contact and secondly when the piece 15 has been moved so that the lever is again free to rock under the effect of the spring 54.

Figure 9A:
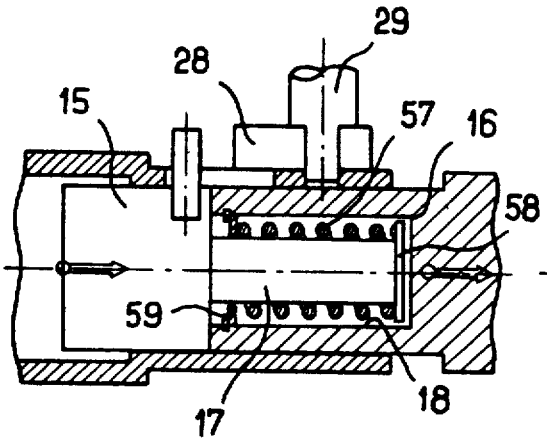
FIGS. 9A and 9B are views showing a third embodiment.
Figure 9B:
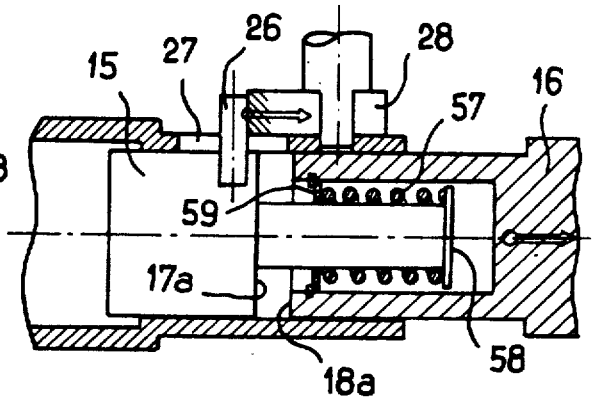

Finally, FIGS. 9A and 9B show a last embodiment of the invention. The portion of end 17 of the piece 15 is smaller in diameter than the bore 18 of the piece 16. The annular space provided in this way serves to receive a compressed spring 57 between a shoulder 58 carried by the portion of end 17 and a shoulder 59 provided at the inlet to the bore 18. The force developed by the spring presses the surface of shoulder 17*a* and front surface 18*a* against each other and constitutes the coupling force. When this force is overcome, the pieces 15 and 16 are free to move relative to each other (FIG. 9B). This solution can be applied to pumps having low suction force only so that the coupling force remains low. Unlike the other embodiments, in this case, for a given coupling force, the lower the adjusted flow rate, the more the spring is stressed beyond its set value and the opposing force increases as and when the spring is compressed during the relative displacement of these two pieces, with this opposing force being transmitted to the abutment 28 via the finger 26 of the piece 15. That is why it is preferable to use this solution for pumps having a low value spring setting and relatively small variation in flow rate adjustments.

I claim:

1. Moving equipment for applying reciprocating drive to the diaphragm of a mechanically actuated diaphragm pump of adjustable stroke, the moving equipment comprising a slider slidably mounted in a fixed guide co-operating at one of its ends with an eccentric drive device whose eccentricity defines the maximum amplitude of the stroke of the slider in the guide, and coupled at its other end to the membrane, wherein the slider is telescopic, having two pieces slidable relative to each other parallel to the guide, one of the pieces being a driving piece which is coupled to the eccentric and the other of the pieces being a driven piece which is coupled to the diaphragm, both pieces being held pressed against each other when the slider is in a retracted state by means of a coupling member developing a determined holding force, while the driven piece of the slider possesses an abutment member which cooperates with an abutment whose position along the guide is adjustable to interfere with the stroke of said driven piece to limit its amplitude to a fraction of the maximum amplitude generated by rotation of the eccentric and which opposes the holding force with a force that is at least equal thereto, thereby causing the slider to be extended.

2. Moving equipment according to claim 1, wherein the abutment of the driven piece is a radial finger received in a longitudinal slot of the fixed guide, the abutment whose position along the guide can be adjusted being constituted by an eccentric disk whose angular position about a pivot shaft engaging the guide and parallel to the finger is adjustable so that the disk covers a length of the slot which depends on its angular position.

3. Moving equipment according to claim 1, wherein the coupling member includes at least one moving locking item for locking together the two pieces and cooperating with a camming surface carried by one of the two pieces and tending to retract the moving item radially into a recess provided in the other piece against the force of a resilient return member.

4. Moving equipment according to claim 1, wherein the end of the driving piece of the slider furthest from the eccentric includes a bore in which the end of the driven piece furthest from the diaphragm is slidably received, the moving locking item being constituted by a ball received in a recess provided radially in one of the pieces and subjected to the effect of a resilient member tending to urge it out from the recess, the camming surface being constituted by the side of a groove provided in the other piece.

5. Moving equipment according to claim 4, wherein the recess is provided in the driven piece and the groove is provided in the driving piece.

6. Moving equipment according to claim 5, wherein the resilient member is disposed in the radial recess.

7. Moving equipment according to claim 5, wherein the resilient member is constituted by a spring received axially in the driven piece between a fixed abutment thereof and a cam sliding axially in the driven piece and bearing under thrust from the spring against the ball via a diverging camming surface.

8. Moving equipment according to claim 7, wherein the cam or the driven piece includes an adjustment member for setting the spring.

9. Moving equipment according to claim 7, including a plurality of locking balls regularly distributed in a common radial plane in the driven piece.

10. Moving equipment according to claim 4, wherein the recess is provided in the driving piece and the groove is provided in the driven piece.

11. Moving equipment according to claim 10, wherein the resilient member is constituted by at least one resilient blade disposed in an external groove of the driving pieces into which the recess opens out.

12. Moving equipment according to claim 3, wherein the coupling member includes a clamp fixed to one of the pieces and having a plurality of teeth which are resiliently deformable in a radial direction and which have free ends, thereby forming the moving locking item, which teeth are engaged in a groove of the other piece when the slider is in the retracted state.

13. Moving equipment according to claim 1, wherein the coupling member comprises a locking crank rocking on the driven piece and engaged behind an abutment of the driving piece when the slider is retracted under urging from a resilient member, the crank including an operating lever whose free end constitutes the abutment member of the driven piece rocking against the effect of the resilient member in the crank disengagement direction when coming into contact with the abutment whose position along the guide is adjustable.

14. Moving equipment according to claim 1, wherein the coupling member is constituted by a resilient member disposed between the two pieces of the slider and whose effect tends to hold the slider in its retracted position under a determined force.

15. Moving equipment according to claim 1, wherein the resilient member is constituted by a piece of elastomer.

* * * * *